US010570923B2

(12) United States Patent
Ravi et al.

(10) Patent No.: US 10,570,923 B2
(45) Date of Patent: Feb. 25, 2020

(54) SCROLL FOR A TURBOMACHINE, TURBOMACHINE COMPRISING THE SCROLL, AND METHOD OF OPERATION

(71) Applicant: Nuovo Pignone Srl, Florence (IT)

(72) Inventors: Shanmugam Venkatachalam Ravi, Karnataka (IN); Marco Giachi, Florence (IT); Dante Tommaso Rubino, Florence (IT); Ernani Fulvio Bellobuono, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 373 days.

(21) Appl. No.: 15/302,697

(22) PCT Filed: Apr. 2, 2015

(86) PCT No.: PCT/EP2015/057349
§ 371 (c)(1),
(2) Date: Oct. 7, 2016

(87) PCT Pub. No.: WO2015/155122
PCT Pub. Date: Oct. 15, 2015

(65) Prior Publication Data
US 2017/0030373 A1 Feb. 2, 2017

(30) Foreign Application Priority Data
Apr. 10, 2014 (IT) ..... FI2014A0081

(51) Int. Cl.
*F04D 29/44* (2006.01)
*F04D 29/42* (2006.01)
(Continued)

(52) U.S. Cl.
CPC ..... *F04D 29/444* (2013.01); *F04D 17/10* (2013.01); *F04D 29/284* (2013.01); *F04D 29/4206* (2013.01); *F04D 29/441* (2013.01)

(58) Field of Classification Search
CPC .. F04D 17/122; F04D 29/4206; F04D 29/441; F04D 29/444
See application file for complete search history.

(56) References Cited

U.S. PATENT DOCUMENTS 1,670,065 A 5/1928 Eisenwinter
5,738,492 A * 4/1998 Stanko ..... F04D 29/422 415/211.1
(Continued)

FOREIGN PATENT DOCUMENTS

BE 622082 A 3/1963
CN 1085994 A 4/1994
(Continued)

OTHER PUBLICATIONS

Machine Translation and First Office Action and Search issued in connection with corresponding CN Application No. 201580019177.9 dated Aug. 1, 2018.
(Continued)

*Primary Examiner* — Ninh H. Nguyen
(74) *Attorney, Agent, or Firm* — Baker Hughes Patent Organization

(57) ABSTRACT

A scroll for use in conjunction with a fluid compressor is described. The scroll comprises a fluid inlet adapted to receive a fluid flow and a fluid outlet adapted to discharge the fluid flow. The scroll further comprises a scroll-shaped wall defining an inner flow volume. At least one blade is provided in the inner flow volume of the scroll. The blade is
(Continued)

configured and arranged for correcting a direction of the flow of fluid in the flow volume when the scroll is operating in off-design conditions.

17 Claims, 6 Drawing Sheets

(51) Int. Cl.
*F04D 17/10* (2006.01)
*F04D 29/28* (2006.01)

(56) References Cited

U.S. PATENT DOCUMENTS

| | | | | |
|---|---|---|---|---|
| 5,842,840 | A * | 12/1998 | Korek | F04D 29/441 417/423.14 |
| 6,817,832 | B2 | 11/2004 | Kim et al. | |
| 7,883,312 | B2 * | 2/2011 | Eguchi | F04D 29/162 415/119 |
| 2004/0071549 | A1 | 4/2004 | Kim et al. | |

FOREIGN PATENT DOCUMENTS

| | | | |
|---|---|---|---|
| CN | 1214106 | A | 4/1999 |
| EP | 2055964 | A1 | 5/2009 |
| FR | 967350 | A | 10/1950 |
| JP | 2005194933 | A | 7/2005 |
| SU | 1092305 | A1 | 5/1984 |
| SU | 1483101 | A1 | 5/1989 |

OTHER PUBLICATIONS

First Office Action and Search issued in connection with corresponding RU Application No. 2016138578 dated Oct. 4, 2018 (English Translation not Available).

Italian Search Report and Written Opinion issued in connection with corresponding IT Application No. FI2014A000081 dated Nov. 28, 2014.

International Search Report and Written Opinion issued in connection with corresponding PCT Application No. PCT/EP2015/057349 dated Sep. 8, 2015.

* cited by examiner

STATE OF THE ART 1
13
17
15
19
21
11F
9G
7G
A
A
5

Fig.3
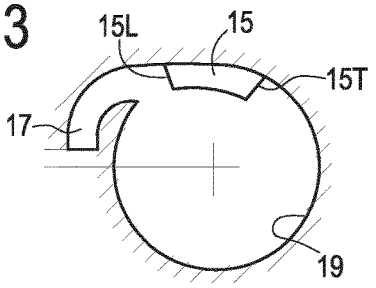
Fig.4
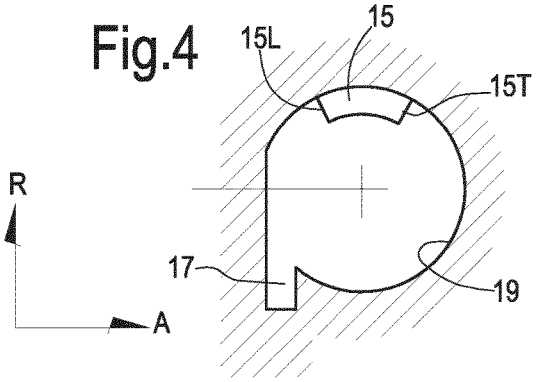
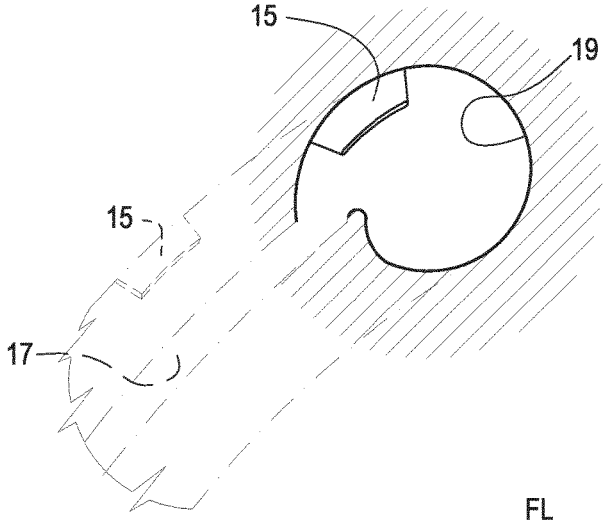
Fig.5
Fig.6
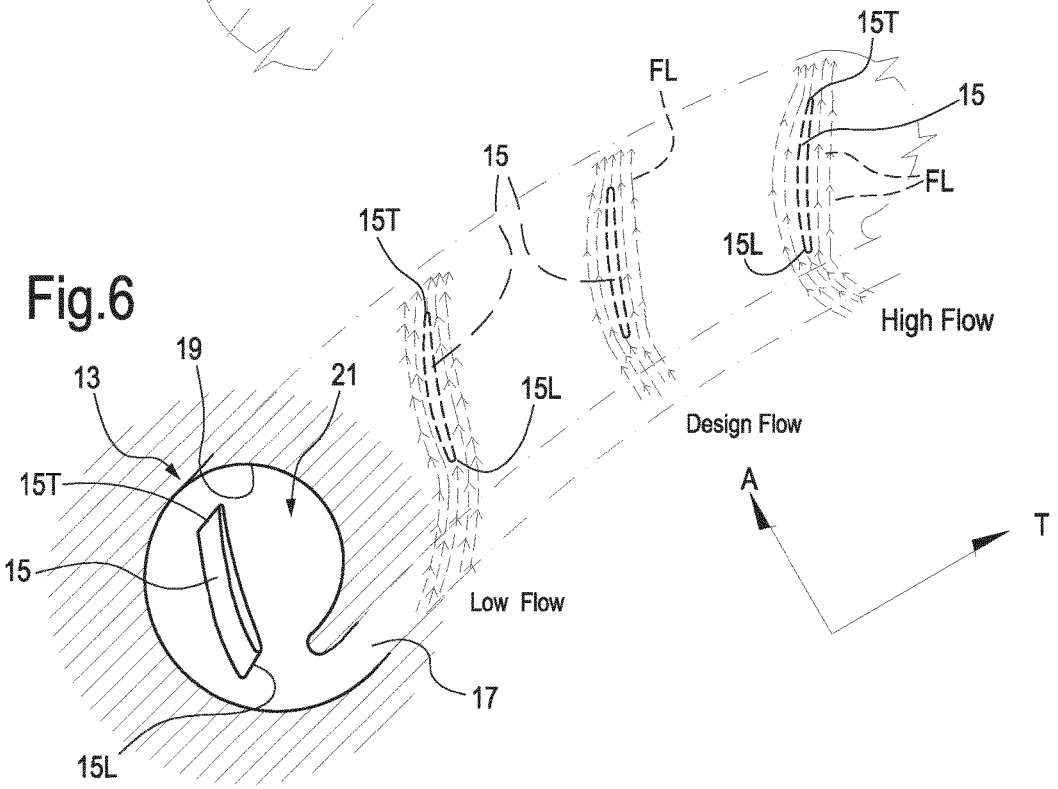

SCROLL FOR A TURBOMACHINE, TURBOMACHINE COMPRISING THE SCROLL, AND METHOD OF OPERATION

BACKGROUND

The subject matter disclosed herein concerns improvements to turbomachines. More specifically, the subject matter disclosed herein concerns improvements to scrolls or volutes for turbomachines, such as centrifugal compressors.

Compressors are used in a wide variety of applications in industry and also in the aviation sector.

A compressor usually comprises one or more sequentially arranged stages, each comprised of a rotating impeller and a diffuser. Gas flows through the impeller and is accelerated by the impeller rotation. The kinetic energy of the gas is at least partially converted into pressure energy in the diffuser. The gas exiting the diffuser is returned to the inlet of the subsequent impeller. The gas exiting the diffuser of the last impeller is delivered to a volute or scroll, wherein the compressed gas is collected and conveyed to the outlet of the compressor.

FIG. 1 illustrates a section along the rotation axis A-A of a multistage centrifugal compressor 100 of the current art. The compressor comprises a casing 101 wherein a rotor 103 is rotatingly housed. The rotor 103 comprises a shaft 105 whereon impellers 107A-107G are mounted. Each impeller 107A-107G is in turn combined with a diffuser 109A-109G. Return channels 111A-111F are arranged downstream each diffuser 109A-109F. Each return channel 111A-111F returns the partially compressed gas from the upstream diffuser 109 to the inlet of the downstream impeller 107.

The gas exiting the last impeller 107G and the last diffuser 109G is collected in a volute or scroll 113, wherefrom the gas is delivered to a compressor outlet (not shown).

Compressors are designed to operate at or around a design point, where the maximum efficiency is achieved. When the operating conditions change the compressor still operates, for example processing a smaller or larger amount of gas, but the overall efficiency of the compressor decreases. The loss of efficiency when operating at a distance from the designed point is caused by various factors partly linked to the modification of the velocity vectors of the gas flow.

Losses are caused in particular also in the volute or scroll 113, when the gas flow rate exiting the diffuser 109G is different from the designed rate. The gas exiting the impeller 107G has a velocity vector with a tangential component and a radial component. The radial component contributes to the actual advancement of the gas in the diffuser 109G, while the tangential component causes losses. The reverse happens in the volute or scroll 113, wherein the tangential component contributes to the advancement of the gas through the scroll towards the outlet, while the axial component of the gas velocity generates vorticity and consequent losses in the flow.

There is a need for improvements to the scroll or volute of a turbomachine such as a centrifugal compressor, in order to reduce the dependency of the efficiency of the scroll of the operating conditions of the turbomachine and in particular to reduce losses when the turbomachine operates far from the designed point.

BRIEF DESCRIPTION

According to a first aspect, the present disclosure concerns a scroll for use in conjunction with a compressor. The scroll comprises a fluid inlet adapted to receive a fluid flow and a fluid outlet adapted to discharge the fluid flow, as well as a scroll-shaped wall defining an inner flow volume. The fluid can be a dry gas, or a wet gas, i.e. containing a fraction of liquid, e.g. in the form of droplets.

According to the present disclosure, the scroll is provided with at least one blade in the inner flow volume thereof. The blade protrudes from the scroll-shaped wall for correcting a direction of the fluid flow in the flow volume when the scroll is operating in off-design conditions. In an embodiment, the blade is configured so as to maintain constant the ratio between the axial component and the tangential component of the fluid velocity, upon variation of the flow rate, or at least to reduce such variations induced by variations of the flow rate. The efficiency of the scroll is thus made less dependent upon the operation conditions of the scroll and thus of the compressor wherein the scroll is arranged. As will become apparent from the description of some embodiments, the blade corrects the direction of the flow when the scroll operates in off-design conditions, thus at least reducing the deviation of the velocity direction in the scroll with respect to the velocity direction at design-point operation.

In an embodiment, a plurality of blades is provided along the extension of the scroll, so that a plurality of guide vanes is defined therewith. Arranging a plurality of blades improves the effect of the blades on the fluid flow direction.

According to a further aspect, the present disclosure concerns a compressor, such as a centrifugal compressor, with a scroll provided with one or more blades arranged therein and defining guide vanes in the scroll, to reduce the negative effect on the scroll efficiency caused by off-design operation of the compressor.

According to yet a further aspect, a method of operating a compressor is disclosed herein, which comprises the steps of generating a fluid flow with at least one rotating impeller; and guiding the fluid flow through a scroll using at least one blade protruding from the scroll-shaped wall for modifying the direction of the fluid flow in the scroll when the compressor operates in off-design conditions, so as to reduce variations of the ratio between axial component and tangential component of the flow velocity caused by the off-design operation of the compressor.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the embodiments of the present invention. It is important, therefore, that the claims be regarded as including such equivalent constructions insofar as they do not depart from the spirit and scope of the embodiments of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIGS. 3 and 4 illustrate two schematic cross sectional views of alternative embodiments of a scroll according to the present disclosure;

FIG. 5 illustrates a perspective fragmentary view of a portion of a scroll according to the present disclosure;

FIG. 6 illustrates a schematic view of a portion of a scroll with guide vanes showing various flow conditions in the guide vanes and around the blades defining the guide vanes;

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the application. Instead, the scope of the application is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
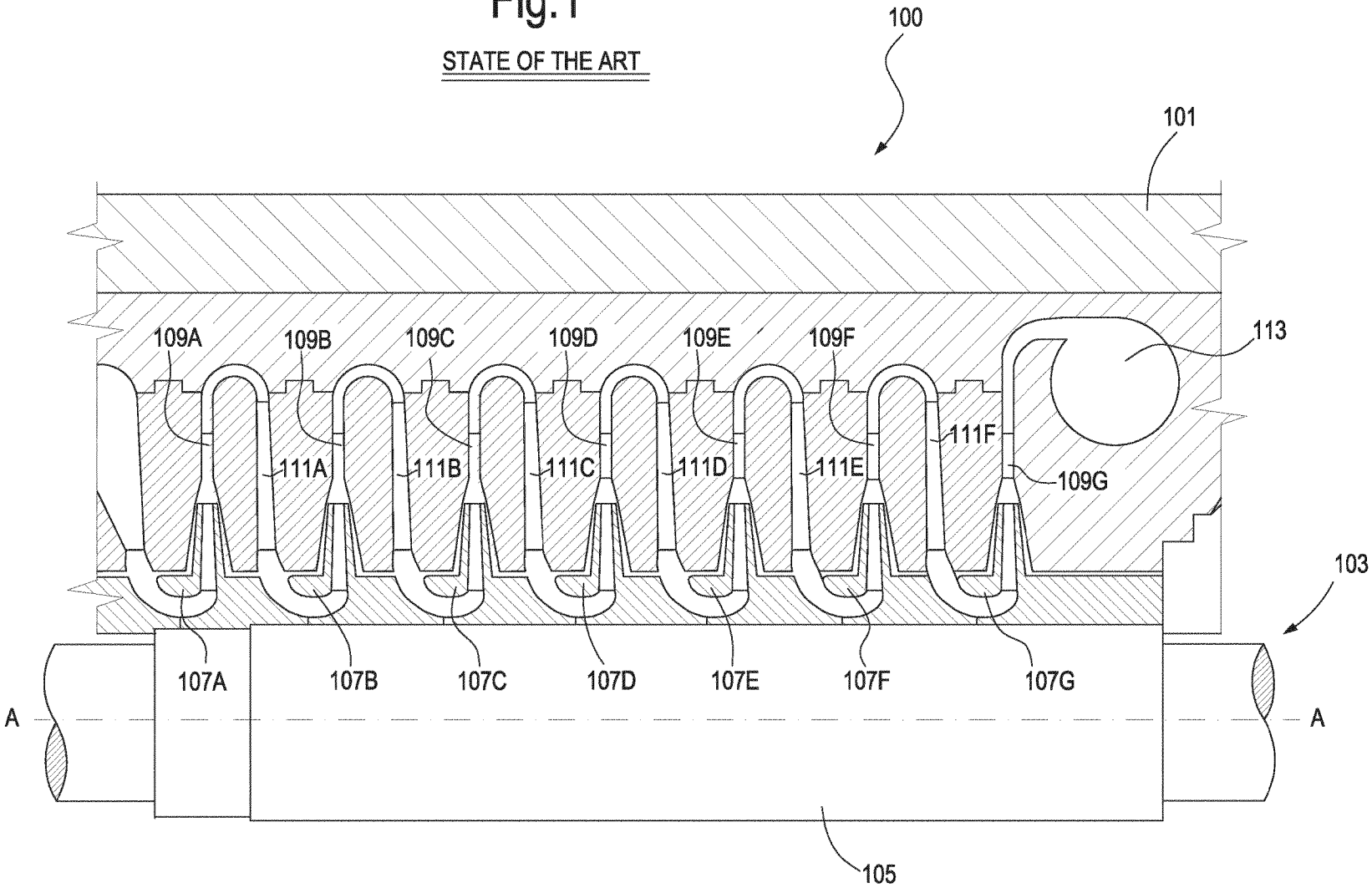
FIG. 1 is a sectional view of a multistage centrifugal compressor of the current art.
Figure 2:
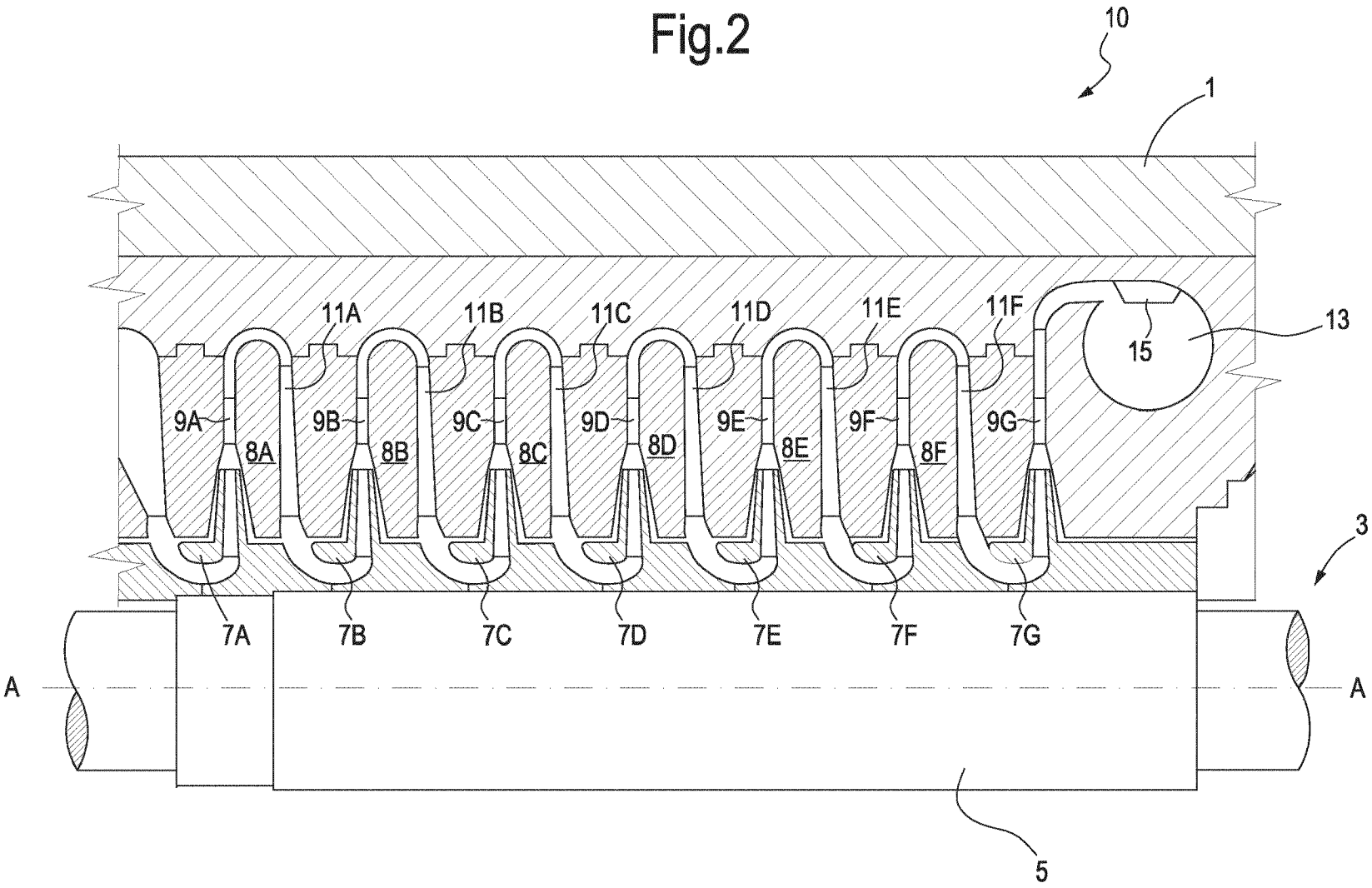
FIG. 2 is a sectional view of a centrifugal multistage compressor embodying the subject matter disclosed herein.

FIG. 2 schematically illustrates a sectional view along the rotation axis A-A of multistage centrifugal compressor 10 embodying the subject matter disclosed herein. The compressor comprises a casing 1, wherein a rotor 3 is rotatingly housed. The rotor 3 comprises a shaft 5 whereon impellers 7A-7G are mounted. Each impeller 7A-7G is in turn combined with a diffuser 9A-9G. Return channels 11A-11F are arranged downstream each diffuser 9A-9F. Each return channel 11A-11F returns the partially compressed gas from the upstream diffuser 9 to the inlet of the downstream impeller 7.

The gas exiting the last impeller 7G and the last diffuser 9G is collected in a volute or scroll 13, wherefrom the gas is delivered to a compressor outlet (not shown).

According to the present disclosure, in order to improve scroll efficiency at off-design operating conditions, at least one blade is provided in the scroll, arranged and configured for reducing the losses due to flow direction variations induced by variable flow rate across the compressor.

As shown for the compressor of FIG. 2, in some embodiments the scroll or volute 13 is provided with a plurality of blades 15. The blades 15 can be arranged at constant pitch. According to other embodiments, the blade pitch can vary along the extension of the scroll. The blades 15 define guide vanes therebetween.

Figure 2A:
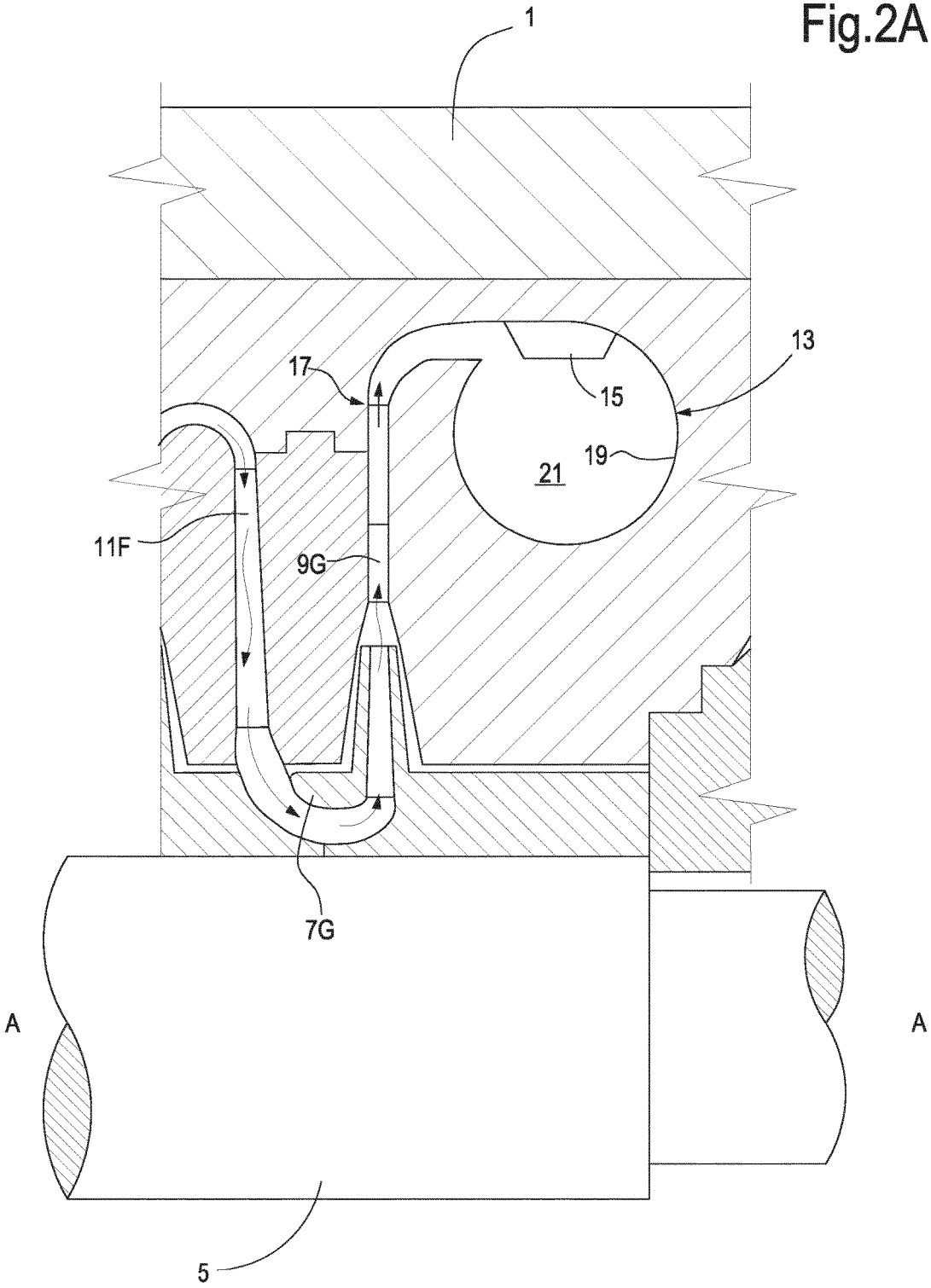
FIG. 2A illustrates an enlargement of the volute or scroll of the compressor of FIG. 2.
Figure 7B:
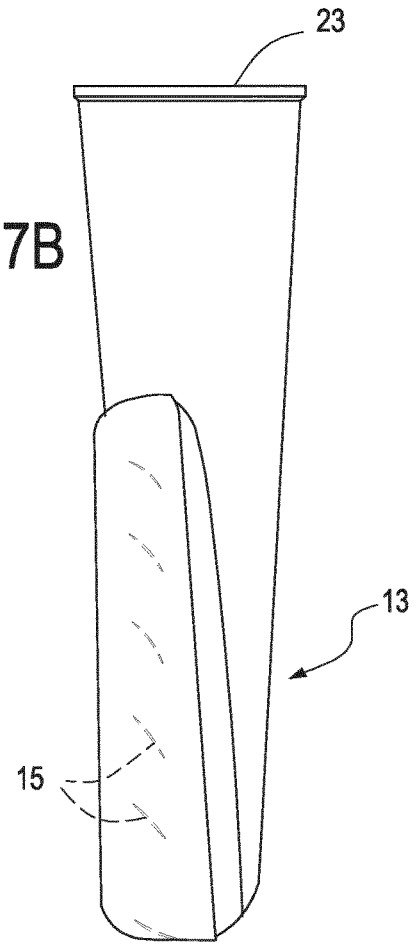
FIGS. 7A, 7B and 7C illustrate views and details of a scroll with guide vanes arrangements as disclosed herein.

According to some embodiments, the scroll 13 comprises a fluid inlet 17 (see in particular FIGS. 2A, 3 and 4), which is in flow communication with the diffuser 9G of the last compressor stage. The scroll 13 can further comprise a scroll-shaped wall 19, which defines an inner flow volume 21, in which the blades 15 protrude from the scroll-shaped wall 19. As best shown in the schematic view of FIGS. 7B and 7C the inner flow volume 21 of scroll 13 has a gradually increasing cross-section, in order to accommodate the increasing amount of gas entering the scroll from the fluid inlet 17. According to other embodiments, not shown, the cross-section of the scroll can remain constant. The inner flow volume 21 is in communication with a fluid outlet 23, which merges with the compressor outlet or delivery manifold (not shown).

Figure 7A:
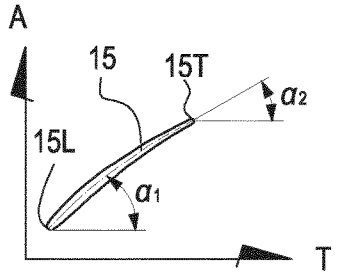
Figure 7C:
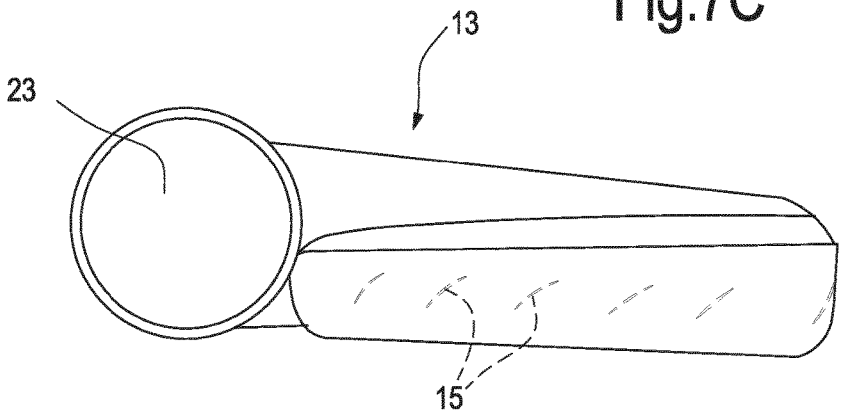

In some embodiments, the blades 15 extend from a leading edge 15L to a trailing edge 15T, see FIG. 7A. The leading edge 15L is proximate the flow inlet 17, while the trailing edge 15T is distant therefrom. In some embodiments, the blades 15 are arranged along a portion of the scroll-shaped wall 19, which is located in the radial outmost area of the scroll-shaped wall 19, i.e. distant from the rotation axis A-A of the compressor rotor 3.

In some embodiments, the blades 15 are inclined with respect to the axial direction and to the tangential direction, which are schematically represented by arrows A and T respectively (FIGS. 6, 7A). R indicates the radial direction.

The inclination of the blades 15 can be best appreciated looking at FIGS. 6 and 7A. In some embodiments the camber line of the blades 15 forms an angle $\alpha 1$ with the tangential direction T at the leading edge, i.e. the first edge encountered by the gas flow flowing in the scroll 13. The blade 15 or the camber line thereof forms with the tangential direction T an angle $\alpha 2$ at the trailing edge 151 of the blade 15. The angle $\alpha 2$ is usually different from and, in some embodiments, smaller than $\alpha 1$ In other embodiments, the blades 15 can be straight, in which case they will form the same angle with the tangential direction T at both the trailing edge and the leading edge.

As can be seen in FIGS. 3 and 4, blades 15 can be provided for different scroll designs. In FIG. 3 an internal scroll is shown, while in FIG. 4 an external scroll is illustrated. In both cases blades 15 are provided along the radial outermost portion of the scroll-shaped wall 19, developing from a leading edge 15L adjacent or proximate the inlet 17 to a trailing edge 15T, further away from the inlet 17.

In some embodiments, as shown for instance in FIG. 6, the blades can have a variable thickness along the development thereof from the leading edge to the trailing edge. In other embodiments, the thickness of the blades 15 can be constant along the entire development thereof.

FIG. 6 graphically illustrates the function and the effect of the blades 15 arranged along the tangential development of the scroll 13. The function of the blades 15 is to maintain a constant (or at least to reduce the variation of) the ratio between axial and tangential components of the gas velocity at the scroll inlet at any operating condition. This reduces the losses due to the variation of the flow direction with respect to the design point, when the compressor operates in off-design conditions, for example with a higher or lower flow rate.

In FIG. 6 three blades 15 and relevant guide vanes defined there between are shown. Each blade 15 is surrounded by lines FL representing the fluid flow entering the scroll 13 at the inlet 17. The intermediate blade 15 is represented in a design flow condition, i.e. when the compressor operates at design conditions and the flow rate corresponds to the flow rate for which the compressor has been designed. The fluid flow exiting the diffuser 9G has a velocity with a radial component and a tangential component. Entering the scroll 13 the fluid flow is diverted into the inner flow volume 21, so that the fluid flow will have a velocity with a tangential component and an axial component. The tangential component of the fluid velocity in the diffuser does not contribute to flow delivery, while the radial component contributed to the advancement of the gas through the compressor.

Conversely, in the volute or scroll 13, the tangential component of the fluid velocity contributes to the advancement of the fluid flow along the inner flow volume 21 towards the fluid outlet 23 of scroll 13.

The compressor is designed such that under design operating conditions the scroll 13 is correctly matched with the flow direction, schematically represented by the line FL with respect to the tangential direction T, which results in a minimum of losses in the scroll 13.

According to some embodiments, if the blades 15 are shaped with a cambered airfoil, they contribute to divert the flow entering the volute or scroll 13 so that the tangential component of the flow velocity increases with reference to the design point. According to some embodiments, the shape of the blades can be such that they do not provide any deviation when the compressor is operating at design point.

If the compressor operates in off-design conditions, with a flow rate higher than the designed flow rate, the tangential component of the fluid velocity is reduced, while the radial component of the fluid velocity in the diffuser and therefore the axial component of the fluid velocity at the inlet of the volute or scroll 13 increases. This high flow condition is represented in the right hand side of FIG. 6, where the lines FL representing the stream of the fluid flow are more axially oriented than in the design flow conditions. The presence of the blades 15 causes a deflection of the stream entering the inner flow volume 21 of the scroll 13, as schematically shown in the right hand side of FIG. 6, so that the flow leaving the blades 15 is directed substantially in the same direction, i.e. with the same velocity orientation as under design conditions.

If the compressor operates at a lower flow rate with respect to the designed flow conditions, the fluid flow entering the scroll 13 will have a larger tangential velocity component than under design conditions. The low flow condition is represented schematically in the left-hand side of FIG. 6.

The blades 15 again deflect the incoming fluid flow, so that at the trailing edge of the blades 15 the fluid velocity will be directed substantially in the same direction as under design flow conditions.

Comparing the three flow conditions schematically represented in FIG. 6, it can be appreciated that the presence of blades 15 distributed along the tangential development of scroll 13 reduces the change in fluid velocity direction when the operating conditions of the compressor change and become different from the design flow conditions.

This results in a reduction of the flow losses due to the increase of the flow rate above the design flow rate or the decrease of the flow rate under the design flow rate, respectively.

Figure 8:
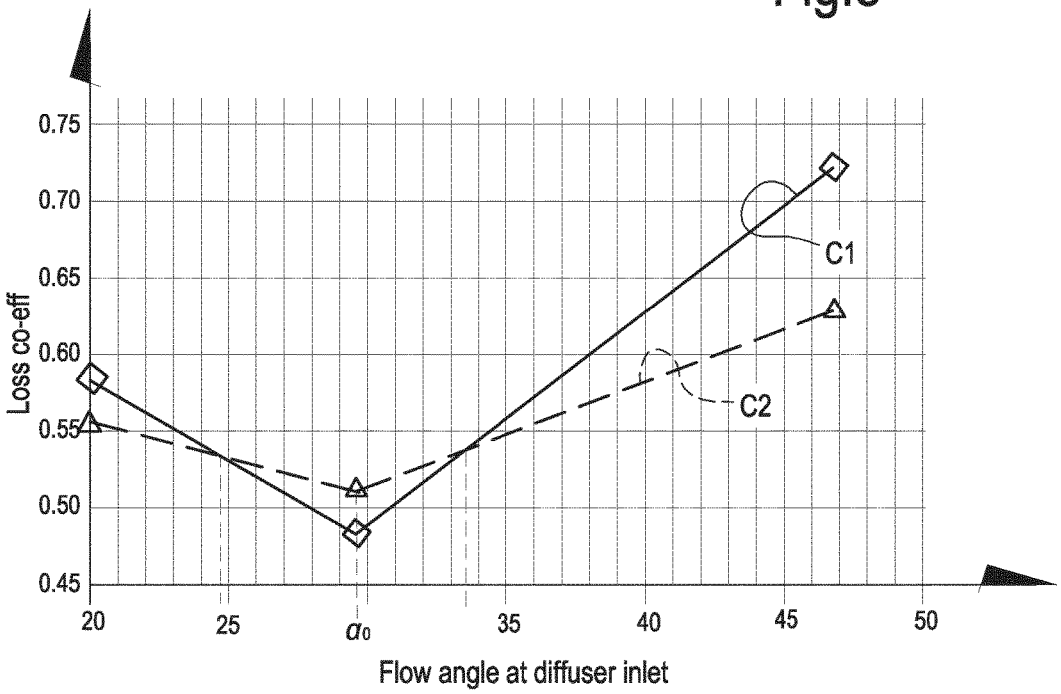
FIGS. 8 and 9 illustrate the loss coefficient of the scroll vs. the flow angle at the diffuser inlet of the last compressor stage with and without guide vanes in the scroll.
Figure 9:
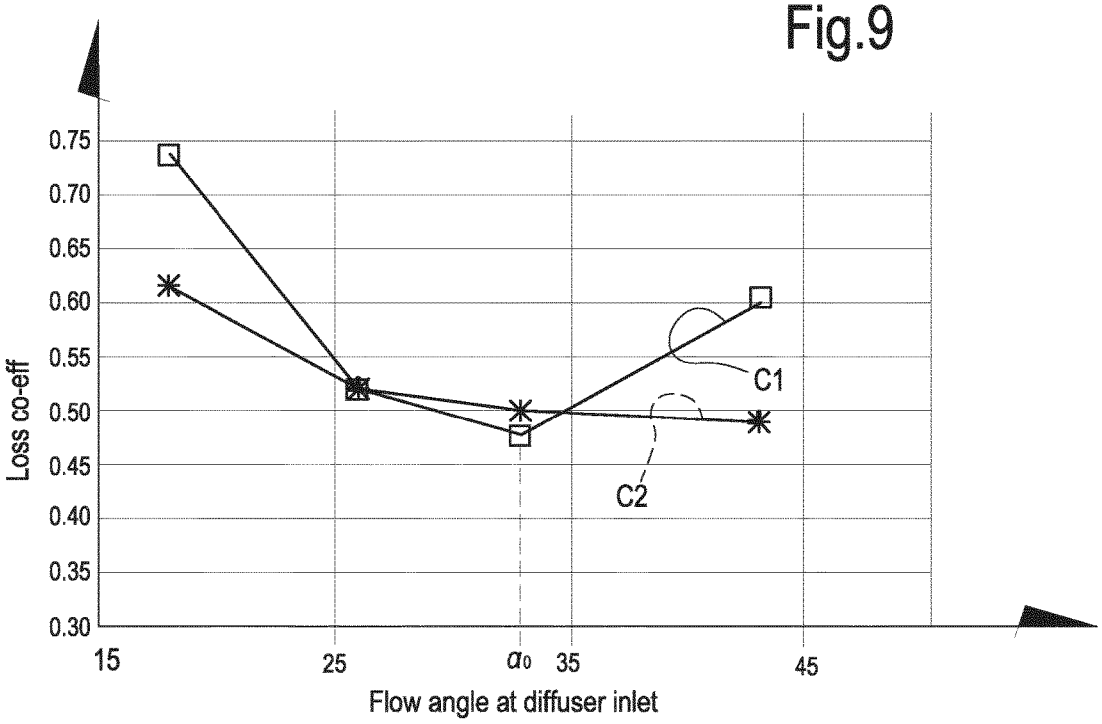

Numerical simulations on flow losses in different centrifugal compressors under variable flow rate conditions are shown in FIGS. 8 and 9, with and without the use of blades as disclosed herein. In FIG. 8 a first diagram is shown, wherein the flow angle at the diffuser inlet in the last compressor stage is reported along the horizontal axis. The loss coefficient is reported on the vertical axis. Curves C1 and C2 represent the loss coefficient vs. the flow angle at the diffuser inlet, respectively without and with the blades 15. Angle $\alpha$0 is the flow angle at the diffuser inlet under design conditions. The flow angle and loss coefficient values reported on the X and Y axes of the diagram relate to exemplary embodiments and shall not be considered as limiting the scope of the present disclosure.

The loss coefficient is minimized when the compressor is operating with a flow angle of $\alpha$1. Curve C1 shows a steep increase of the loss coefficient, when the operating conditions move from the design flow angle $\alpha$0 towards both a lower as well as a higher flow angle value.

Curve C2 illustrates a similar behavior, but with much less steep increase of the loss coefficient when moving from the design flow angle condition $\alpha$0 towards a lower or a higher flow angle value, respectively. The minimum loss coefficient at design conditions ($\alpha$0) is slightly higher for curve C2. This takes into consideration the fact that the blades 15 introduce a certain amount of friction losses in the scroll 13, which are absent if no blades 15 are used. However, as soon as the operating conditions move from the design conditions towards a higher flow rate or a lower flow rate, the blades redirecting the flow in the scroll 13 overcomes the disadvantage of a higher friction, thus reducing the loss coefficient.

In the simulation of FIG. 9, a similar situation is shown, wherein the minimum loss coefficient is obtained without blades 15 at a flow angle at diffuser inlet at $\alpha$0. A steep increase of the loss coefficient is caused as soon as the flow conditions depart from the design conditions $\alpha$0 (curve C1). Conversely, if blades 15 are used (curve C2) the loss coefficient is maintained at substantially lower values when operating distant from the design conditions. Around the design conditions, a small and almost negligible increase of the loss coefficient is again due to the introduction of the friction on the surfaces of the blades 15.

In the embodiments disclosed above the blades 15 are stationary with respect to the scroll. In other embodiments, one, some or all the blades 15 can be movable. In some embodiments the blades 15 can be pivoted to the scroll so that their inclination can be adjusted, e.g. depending upon the flow rate.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. Different features, structures and instrumentalities of the various embodiments can be differently combined.

What is claimed is:

1. A scroll for use in conjunction with a fluid compressor, the scroll comprising:
a fluid inlet adapted to receive a flow of fluid;
a fluid outlet adapted to discharge the flow of fluid;
a scroll-shaped wall defining an inner flow volume; and
at least one blade in the inner flow volume protruding from the scroll-shaped wall for correcting a direction of the flow of fluid in the inner flow volume, when the scroll is operating in off-design conditions, wherein a plurality of blades are arranged in the inner flow volume of the scroll, along at least a portion of a circular development thereof.

2. The scroll of claim 1, wherein the blades are arranged according to a constant pitch around the scroll.

3. The scroll of claim 2, wherein each blade is oriented and configured so as to at least reduce a variation of a ratio between axial component and tangential component of a fluid velocity at variable operating conditions.

4. The scroll of claim 1, wherein each blade is oriented and configured so as to at least reduce a variation of a ratio between axial component and tangential component of a fluid velocity at variable operating conditions.

5. The scroll of claim 1, wherein each blade extends along the wall from a leading edge, located proximate the fluid inlet, to a trailing edge.

6. The scroll of claim 1, wherein each blade has an inclination with respect to an axial direction.

7. The scroll of claim 1, wherein each blade is arranged transversally with respect to the direction of the flow.

8. The scroll of claim 1, wherein each blade is oriented and configured so as to at least reduce a variation of a ratio between axial component and tangential component of a fluid velocity at variable operating conditions.

9. A scroll for use in conjunction with a fluid compressor, the scroll comprising:
a fluid inlet adapted to receive a flow of fluid;
a fluid outlet adapted to discharge the flow of fluid;
a scroll-shaped wall defining an inner flow volume; and
at least one blade in the inner flow volume protruding from the scroll-shaped wall for correcting a direction of the flow of fluid in the inner flow volume, when the scroll is operating in off-design conditions, wherein each blade forms an angle with respect to an axial direction, the angle being variable from the leading edge to the trailing edge of the blade.

10. The scroll of claim 9, wherein the angle between the blade and the axial direction increases from the leading edge to the trailing edge.

11. A scroll for use in conjunction with a fluid compressor, the scroll comprising:
a fluid inlet adapted to receive a flow of fluid;
a fluid outlet adapted to discharge the flow of fluid;
a scroll-shaped wall defining an inner flow volume; and
at least one blade in the inner flow volume protruding from the scroll-shaped wall for correcting a direction of the flow of fluid in the inner flow volume, when the scroll is operating in off-design conditions, wherein each blade extends radially inwardly from a radial outer portion of the scroll-shaped wall.

12. A scroll for use in conjunction with a fluid compressor, the scroll comprising:
a fluid inlet adapted to receive a flow of fluid;
a fluid outlet adapted to discharge the flow of fluid;
a scroll-shaped wall defining an inner flow volume; and
at least one blade in the inner flow volume protruding from the scroll-shaped wall for correcting a direction of the flow of fluid in the inner flow volume, when the scroll is operating in off-design conditions, wherein at least one of the blades has an adjustable inclination with respect to a tangential direction.

13. A compressor comprising:
at least one impeller;
a scroll comprising:
a fluid inlet adapted to receive a flow of fluid;
a fluid outlet adapted to discharge the flow of fluid;
a scroll-shaped wall defining an inner flow volume; and
at least one blade in the inner flow volume protruding from the scroll-shaped wall for correcting a direction of the flow of fluid in the inner flow volume, when the scroll is operating in off-design conditions,
wherein the scroll is arranged for receiving a fluid flow from the at least one impeller; and
a diffuser between the impeller and the scroll, configured and arranged to receive the fluid flow from the impeller and direct the fluid flow to the fluid inlet of the scroll.

14. The compressor of claim 13, wherein the diffuser is bladed.

15. A method of operating a compressor, the method comprising:
generating a fluid flow with at least one rotating impeller;
guiding the fluid flow through a scroll using at least one blade protruding from the scroll-shaped wall for modifying the direction of the fluid flow in the scroll when the compressor operates in off-design conditions, so as to reduce variations of a ratio between an axial component and a tangential component of a fluid flow velocity induced by variable flow rate conditions through the compressor; and
arranging a plurality of blades in the scroll.

16. The method of claim 15, further comprising:
with the at least one blade, increasing a tangential velocity component of the fluid flow if the compressor is operating at a flow rate above the design flow rate; and
with the at least one blade, reducing the tangential velocity component of the fluid flow if the compressor is operating at a flow rate below the design flow rate.

17. A method of operating a compressor, the method comprising:
generating a fluid flow with at least one rotating impeller;
guiding the fluid flow through a scroll using at least one blade protruding from the scroll-shaped wall for modifying the direction of the fluid flow in the scroll when the compressor operates in off-design conditions, so as to reduce variations of a ratio between an axial component and a tangential component of a fluid flow velocity induced by variable flow rate conditions through the compressor;
with the at least one blade, increasing a tangential velocity component of the fluid flow if the compressor is operating at a flow rate above the design flow rate; and
with the at least one blade, reducing the tangential velocity component of the fluid flow if the compressor is operating at a flow rate below the design flow rate.

* * * * *